United States Patent [19]

Walter

[11] 3,975,882

[45] Aug. 24, 1976

[54] PANEL STRUCTURE

[76] Inventor: James A. Walter, 7155 N. Figueroa St., Los Angeles, Calif. 90042

[22] Filed: Sept. 2, 1975

[21] Appl. No.: 609,376

Related U.S. Application Data

[63] Continuation of Ser. No. 155,939, June 23, 1971, abandoned.

[52] U.S. Cl. ..... 52/571; 52/621; 93/1.1; 93/1 H; 428/33; 428/99; 156/93; 156/210

[51] Int. Cl.[2] ..... E04B 1/02; E04C 1/04

[58] Field of Search ..... 52/570, 571, 618–622, 52/588; 93/1.1, 1 H; 428/33, 99; 156/93, 210

[56] References Cited

UNITED STATES PATENTS 1,381,823 6/1921 Griffin ..... 52/277

3,544,417 12/1970 Corzine ..... 428/178

FOREIGN PATENTS OR APPLICATIONS 1,077,164 4/1954 France ..... 52/618

*Primary Examiner*—Ernest R. Purser
*Assistant Examiner*—James L. Ridgill, Jr.
*Attorney, Agent, or Firm*—Georges A. Maxwell

[57] ABSTRACT

A rigid panel structure comprising a pair of flexible sub-assemblies, each with a plane, flat outer skin and a corrugated backing, the corrugated backings of the sub-assemblies establishing meshed seated engagement with each other and locking means comprising opposing stop shoulders on the flank portions of the adjacent opposing flank portions of the meshed corrugations.

16 Claims, 11 Drawing Figures

Inventor
James Walter
By
Attorney 10
16
S
11
18'
40
20'
15
17
C
B2
S2
20b
C4
55
50
S3
18a
20a
40'
C3
B3
B
Inventor
James Walter
By
Attorney

PANEL STRUCTURE

This application is a continuation of my earlier filed copending application Ser. No. 155,939, filed June 23, 1971, now abandoned, for PANEL STRUCTURE.

This invention has to do with a novel, improved fabricated panel structure and is more particularly concerned with a panel structure which is such that it can be disassembled and rolled up for shipping and/or storage; and such that is can be easily and advantageously assembled to establish structurally strong and rigid panels in either flat or curved, that is, radiused form.

Throughout the many arts, there is an ever increasing need for easy and economical make and assembly panel structures, and for such structures for both permanent or temporary use.

There is also an increasing need for panel structures which are or can be finished on both sides and for such structures which can be advantageously set up in a bent or radiused form, as for the purpose of establishing rounded and finished corners or the like and without the necessity of undertaking costly and complicated building procedures.

The need for such panel structures can be found in and throughout the building trades for the establishment of walls and partitions and can be found through the various industrial trades for establishing bins, cargo containers, and for satisfying various packaging needs.

There is also a need for such panel structures in establishing inexpensive, yet durable, and portable theatrical sets and in the establishment of merchandise displays in stores, trade shows and the like.

In the past, practically all pre-fabricated panel structures have been flat, rigid structures involving rectangular or other polygonally shaped frame structures and with one or a pair of flat, generally rigid, skin sheets or panels fixed to and overlying the frames. Such structures have been relatively fragile and flimsy units which require their being related and secured to other structures for stability and, as a general rule, require the employment of costly and inconvenient to use connecting and/or securing means to effect their assembly and use.

Attempts to utilize paper in establishing rigid and durable panels has been characterized by flat, rigid panels with corrugated paper cores and with inside and outside paper skins fixed to the cores as by means of glue. Such panels when produced of other than pulp paper and relegated to that type and class of product commonly referred to as corrugated paste board, are, at best, fragile and difficult to ship and to store.

Attempts to improve the strength and durability of such structures has resulted in the use of wood veneer skins, the development of special honeycomb type cores and the use of resins and the like, to impregnate, strengthen and reinforce the resulting product.

In all such products, which provide a reasonable amount of structural strength and durability, the resulting panels are, intentionally, extremely stiff, rigid and are generally brittle in nature.

An object and feature of the present invention is to provide a novel sectional panel structure made up of two, like, light weight, flexible, unitary, sub-assemblies which sub-assemblies, when engaged one with the other establish a strong, rigid and durable panel.

Another object and feature of the invention is to provide a structure of the character referred to wherein the sub-assemblies are such that they can be easily and conveniently rolled up into tight, neat and compact rolls which are easy, convenient and economical to handle, store and ship.

Yet another object and feature of the instant invention is to provide a structure of the character referred to wherein each sub-assembly includes a flexible skin with a finished exterior surface and a corrugated backing fixed to the other or interior surface of the skin, said backing being flexible on its axis extending normal to the axis of its corrugations.

Still another object and feature of the invention is to provide sub-assemblies of the character referred to above wherein the corrugations of the backing of one sub-assembly establishes cooperative interengaged, meshed or mating engagement with the corrugations of the backing of another, oppositely disposed sub-assembly which is moved and urged into back to back relationship with said one sub-assembly.

An object and feature of the present invention is to provide a panel structure of the character referred to wherein the corrugated backings of the sub-assemblies are provided with interengaging locking means to lock the corrugations of engaged together sub-assemblies in tight seated and substantially unyielding engagement with each other whereby the sub-assemblies are not subject to parting or separating one from the other and whereby the corrugations of the backing of each sub-assembly holds captive, supports and reinforces the corrugations of the backing of the other sub-assembly and with the end result that the assembled panel structure is structurally strong, rigid and durable.

It is an object and feature of this invention to provide sub-assemblies of the character referred to wherein the corrugated backings are characterized by zig zag or V-shaped corrugations with flat, angularly related flank portions, the flank portions being of equal lateral extent and the lateral spacing of adjacent corrugations being predetermined and equal in each sub-assembly.

A further object and feature of the invention is to provide a structure of the character referred to wherein the corrugations of the backings of certain sub-assmblies are spaced different predetermined distances apart than the corrugations of the backings of other sub-assemblies and so that when sub-assemblies with corrugations spaced dissimilar distances apart are engaged with each other, they establish structurally rigid and durable curved or radiused panels.

Yet another object is to provide sub-assemblies of the character referred to wherein the locking means includes longitudinally extending stop shoulders on the flanks of the corrugations, which shoulders are disposed toward the skins related to said corrugations which serve to establish opposing stopped engagement with similar stop shoulders of another sub-assembly engaged with said sub-assembly and so the engaged sub-assemblies are locked together in assembly relationship.

It is yet another object and feature of this invention to provide locking means of the character referred to which are such that relative shifting of engaged sub-assemblies parallel with the axes of the corrugations effects disengagement of related stop shoulders and disassembly of the panels.

A further object and feature is to provide a structure of the character referred to wherein the stop shoulders can be coextensive with the corrugations or can be of limited longitudinal extent and spaced longitudinally of the corrugations and a structure wherein said stop shoulders can be established by parts applied to the corrugations or can be established integrally in the corrugations by suitable forming operations.

yet another object and feature of this invention is to provide a structure of the character referred to which is such that it can be established of paper, plastic, wood veneer, sheet metal of of any combination of such materials.

The foregoing and other objects and features of my invention will be apparent and fully understood from the following detailed description of typical preferred forms and applications of the invention, throughout which description, reference is made to the accompanying drawings, in which.

Figures 1, 2, 3, 4, 5, 6:
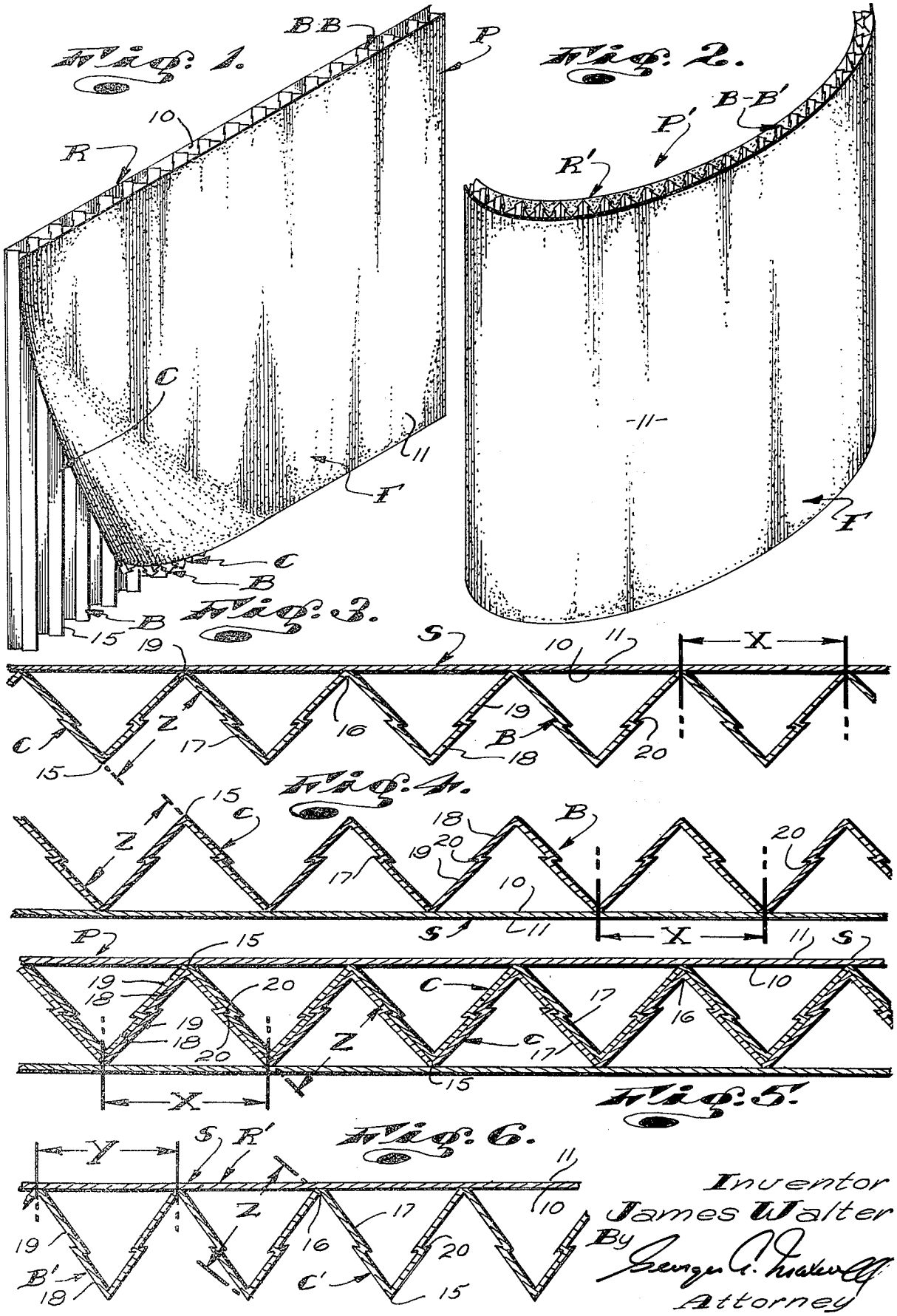
FIG. 1 is an isometric view of a flat panel structure embodying the instant invention.
FIG. 2 is an isometric view of a curved panel structure embodying the instant invention.
FIG. 3 is a horizontal sectional view of a portion of one sub-assembly.
FIG. 4 is a horizontal sectional view of a portion of another sub-assembly.
FIG. 5 is a horizontal sectional view of the sub-assemblies shown in FIGS. 2 and 3, cooperatively engaged with each other.
FIG. 6 is a view similar to FIG. 3 showing a modified sub-assembly for engagement with a sub-assembly as shown in FIG. 5 to establish a curved panel.

Referring to FIGS. 1 and 3 through 5 of the drawings, the panel structure P that I provide includes a pair of similar sub-assemblies, there being front and rear sub-assemblies F and R. Each sub-assembly is an elongate, vertica, rectangular unit having a flat outer skin S and a corrugated backing B.

The skin S of each panel can be established of a flat flexible sheet of plastic, paper, sheet metal or, if desired, thin wood veneer and is characterized by flat inside and outside surfaces 10 and 11. The outside surface 11 can be finished in any desired manner.

The corrugated backing B of each sub-assembly can be formed and established from sheet paper, plastic or metal. The corrugations C of the backing are straight and parallel, extending vertically and normal to the longitudinal axis of sub-assembly and resulting panel P.

In the form of the invention now under consideration, the corrugations C of both sub-assemblies are alike and are V-shaped, being characterized by relatively sharp, straight, outside corners or ridges 15, relatively sharp inside corners or valleys 16 and straight substantially flat flanks 17. The flanks 17 have offset, outer or ridge portions 18 and inner or valley portions 19 defining longitudinally extending, inwardly disposed stop shoulders 20. The ridge and valley portions 18 and 19 of the flanks 17 of the corrugations C are proportioned and arranged so that the stop shoulders occur on the central mean plane of the corrugated backing, that is, on a plane midway between the ridges and valleys of the corrugations.

In practice, the stop shoulders can, as shown in the drawings, occur in planes parallel with the central mean plane of the sub-assemblies and resulting panel, or can be angularly related thereto and disposed laterally inwardly toward the valleys of the related corrugations at angles up to 45°. Angles greater than 45° are not desirable or suitable since they are greater than the mean sheer angle between the engaged shoulders of an assembled panel, as will hereinafter be described and will not afford satisfactory locking effect.

The outside corners of the portions of the corrugated backing establishing the valleys 16 establish bearing contact with the opposing inner surface 10 of skin S related thereto and are fixed to the skin by means of a suitable cement, welding or the like.

The depth and lateral extent of the corrugations indicated at W and X and the lateral spacing of the flanks of the corrugations as indicated at Z are, in the case of a flat, straight panel, alike or the same in the two sub-assemblies going to make up the panel.

Figures 7, 8, 9, 10, 11:
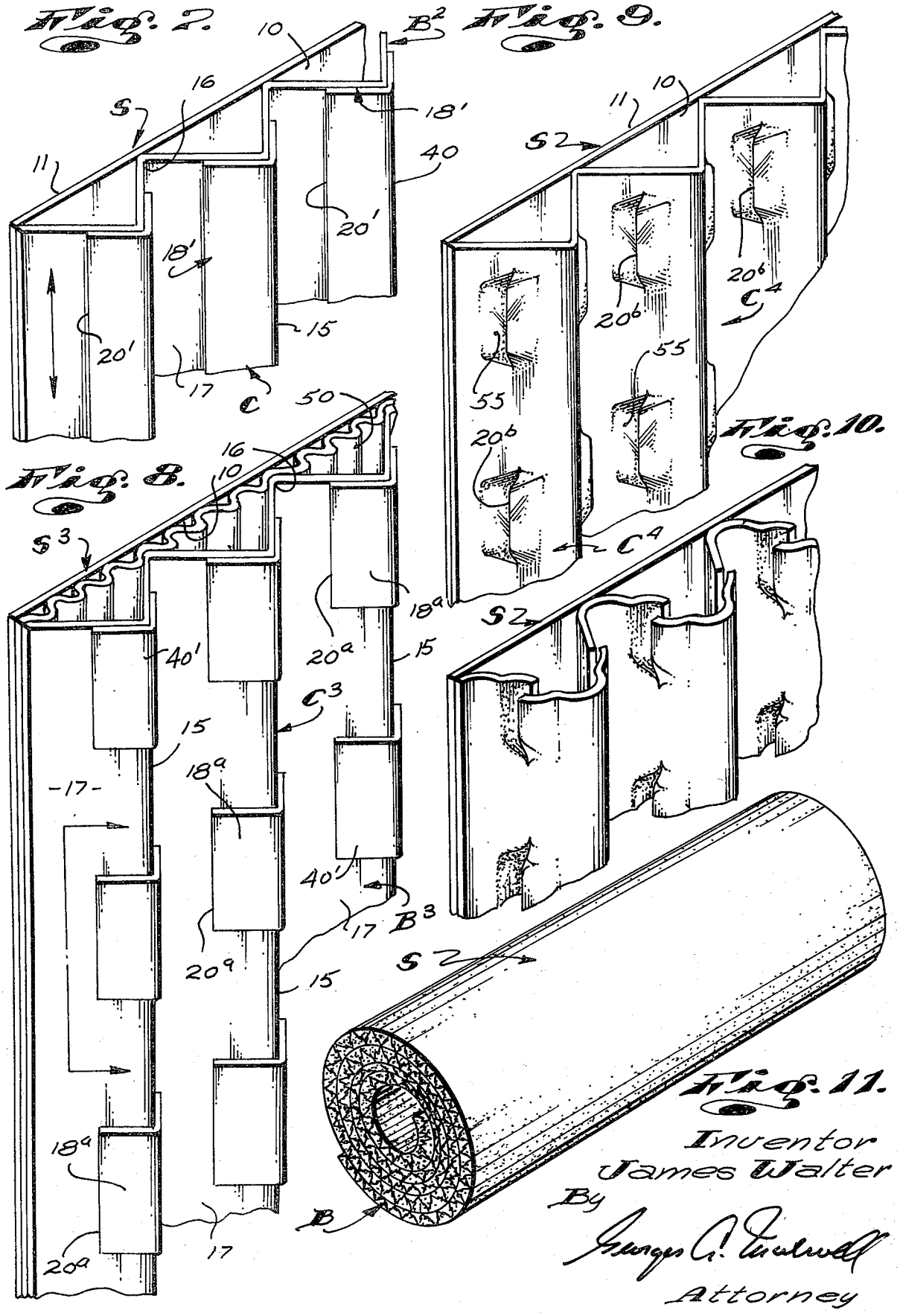
FIG. 7 is an isometric view of a portion of another form of sub-assembly.
FIGS. 8, 9 and 10 are isometric views of portions of other forms of sub-assemblies suitable for carrying out the present invention; and, FIG. 11 is an isometric view showing a sub-assembly rolled up for storage and/or shipment.

The sub-assemblies, as described above, can be rolled up for storage and shipping, as shown in FIG. 11 of the drawings.

When the sub-assemblies F and R are engaged to establish the panel P, the sub-assemblies F and R are arranged with their backings B in adjacent, opposed relationship and with the corrugation ridges 15 of each in alignment with the corrugation valleys of the other. When the sub-assemblies F and R are thus arranged they are urged toward each other so that the corrugations of each enters between and establishes meshed engagement with the corrugations of the others. The major lateral extent of the outer ridge portions of the corrugations C, at the central means plane of the corrugations, is equal to the outer major lateral extent of the inner valleys established by adjacent corrugations, at the central means plane of the corrugations, and is greater than the inner, minor lateral extent or distance between the inner edge portions of ridge portions of adjacent corrugations, at the central means plane of the corrugations. As a result of the above proportioning, as each corrugation of one sub-assembly enters between adjacent corrugations of the other, the innermost edge portions of the ridge portions 18 of the adjacent opposing flanks of the corrugations establish yielding, stopped engagement with each other. Subsequent to establishing the above noted stopped engagement and upon the application of pressure, the adjacent opposing flanks yield so that the inner edged portions of the ridge portions 18 move one by the other, whereupon the ridge portion of each corrugation is received by and seats in the valley portion defined by the two adjacent corrugations and the stop shoulders of adjacent flanks establish opposing, seated engagement with each other to hold and lock the corrugations together in meshed relationship and against disengagement from each other.

It is to be noted that outer normally free and unsupported ridge portions of each corrugation of each sub-assembly is seated in, held and suported by the inner valley established by the anchored and secured portions 19 of the adjacent corrugations of the other sub-assembly and in such a manner that the meshed or interengaged and locked together corrugations of the related sub-assemblies provide both stiffening and structural support for each other and with the result that the assembled panel P is extremely strong and rigid.

If and when it is desired to disassemble the panel P, the sub-assemblies can be shifted vertically relative to each other and in such a manner that the interengaged corrugations are slid out of engagement with each other.

In practice, and when it is desired to establish a curved panel, such as the panel P′, shown in FIG. 2 of the drawings, a pair of sub-assemblies such as the sub-assemblies F and R′, shown in FIGS. 4 and 6 of the drawings, are employed.

The sub-assembly R′ is the same in general construction as the sub-assembly F and utilizes the same corrugated backing material as the sub-assembly F, except that the lateral extent of corrugations C′, as indicated at Y, is a predetermined distance less than the lateral extent X of the corrugations of the sub-assembly F. The lateral extent of the corrugation flanks, as at Z, in the two sub-assemblies F and R′, are the same.

As a result of the above noted differences between the sub-assemblies F and R′, the corrugations of the two sub-assemblies will not register and mesh when the sub-assemblies are laid out or set up flat. However, by curving or bending the sub-assembly F, with its backing B on the inside of the curvature and so as to yieldingly compress and reduce the lateral distance between the ridges of adjacent corrugations and by curving or bending the sub-assembly G′ with its backing B′ on the outside of the curvature and so as to yieldingly spread and increase the lateral distance between the ridges of adjacent corrugations, the corrugations of the two sub-assemblies are biased to a condition where they are complimentary and so that they can be urged into meshed, locked engagement with each other in the same manner as the two like sub-assemblies R and F are engaged one with the other, except that the resulting panel assembly is radiused or curved.

By providing several standard panels, with backings, the corrugations of which are spaced apart different, predetermined distances, flat panels and panels of different curvatures can be advantageously and conveniently established.

While there is a practical limit as to the maximum differential in lateral extent and spacing of corrugations for the establishment of curved panels in accordance with this invention, by providing a plurality of different sub-assemblies with differently spaced corrugations, panels of practically any desired curvature can be provided.

In carrying out this invention, when a wall structure longer than the longitudinal extent of the sub-assemblies and requiring a multiplicity of sub-assemblies arranged end to end is to be established, the sub-assemblies at and establishing one side of the wall structure can be and are preferably offset from the sub-assemblies at and establishing the other side of the wall structure and in such a manner that the related sub-assemblies are scarfed together and establish an integrated assembly of exceptional strength and stability.

In practice and as illustrated in FIG. 7 of the drawings, the offset outer ridge portions 18′ and the stop shoulders 20′ of the corrugated backing $B^2$ can be established by V-shaped cap-strips 40, of cardboard, sheet metal or other suitable material, engaged on and over the ridge portions of the corrugations and suitably fixed thereto.

In practice and as illustrated in FIG. 8 of the drawings, the outer ridge portions 18″ and stop shoulders 20″ need not be continuous and coextensive with the corrugations, but can, as shown, be of limited longitudinal extent and spaced longitudinally of the corrugations whereby opposing related sub-assemblies can be effectively engaged and locked together, as above described, but such that when it is desired to disassemble a panel the related sub-assemblies need only be shifted relative to each other, parallel with the axes of the corrugations, a distance equal to the longitudinal extent of the shop shoulders 20″, whereupon related shoulders of adjacent related sub-assemblies disengage and the sub-assemblies are free to be separated. It is to be noted that in order to facilitate separation of the sub-assemblies by limited relative sliding movement as above set forth, the spaces between adjacent longitudinally spaced stop shoulders on the corrugations must be equal to and preferably slightly greater than the longitudinal extent of the stop shoulders, as illustrated.

As shown in FIG. 8 of the drawings, the sub-assemblies can, if desired, include a central or intermediate core 50 between the backing $B^3$ and skin $S^3$, which core is preferably established of finely corrugated paper; that is corrugated material, with corrugations which are materially smaller and closer together than the corrugations of the backing $B^3$. The core 50 is such that it reinforces the skin $S^3$ and is such that when the sub-assembly is utilized to establish a curved panel, such as is shown in FIG. 2, the skin $S^3$ will bend smoothly and is less subject to being drawn or urged into a ridged or multi-faceted surface.

It is to be noted that the flank portions 18″ and stop shoulders 20″ in FIG. 8 of the drawings are established by short V-shaped cap sections 40′ applied to the ridges of the corrugations $C^3$.

In FIG. 9 of the drawings, stop shoulders 20′ are established in the flanks of straight, plane, corrugations by a suitable piecing and forming operation. The shoulders 20′, like the shoulders 20″ in the last considered form of the invention are of limited longitudinal extent and are spaced longitudinally of the corrugations $C^4$.

In this form of the invention, outer offset flank portions are not required or provided, but flanks of the corrugations of sub-assembly must be formed to accommodate the upset material establishing the stop shoulders of a related sub-assembly. To the above end, the stock of the flanks adjacent to and inward of each shoulder 20′ is upset and moved to form pockets 55 to receive the shoulder defining upset stock, as clearly illustrated.

In FIG. 10 of the drawings, the structure is essentially the same as that shown in FIG. 9, except that the corrugations have radiused ridges and valleys and flat flank portions of limited extent. FIG. 10 is intended to illustrate the fact that the corrugations of the sub-assembly backings need not be V-shaped, but can, in practice, be similar to the more conventional undulating, radiused form of corrugations.

The forms of the invention shown in FIGS. 9 and 10 of the drawings are particularly suitable for use in establishing sub-assemblies with sheet metal backings.

Having described only typical preferred forms and applications of my invention, I do not wish to be limited or restricted to the specific details herein set forth, but wish to reserve to myself any modifications and/or variations that may appear to those skilled in the art to which this invention pertains and which fall within the scope of the following claims.

Having described my invention, I claim:

1. An elongate rigid panel structure of selected longitudinal curvature comprising a pair of elongate flexible sub-assemblies, each sub-assembly including a flat skin with inner and outer surfaces and a corrugated backing fixed to the inner surface of the skin, the corrugations of the backing extending normal to the longitudinal axis of the sub-assemblies and each corrugation having angularly related inwardly convergent flanks, the sub-assemblies being arranged in back to back relationship with the corrugations of each sub-assembly meshed with and seated in the corrugations of the other sub-assembly with the adjacent divergent flanks of adjacent corrugation of each sub-assembly establishing flat opposing engagement with the two convergent flanks of the corrugations of the other sub-assembly related thereto and locking means on and between the adjacent opposing flanks of the meshed corrugations and retaining the corrugations in meshed relationship, the corrugations of one sub-assembly being greater in lateral extent than the corrugations of the other sub-assembly whereby the sub-assemblies are curved longitudinally when engaged one with the other.

2. A structure as set forth in claim 1 wherein the locking means includes outwardly disposed longitudinally extending stop shoulders on the inwardly convergent flanks of the corrugations, the stop shoulders of adjacent opposing corrugation flanks of the related sub-assemblies establishing opposing stop engagement with each other, said flanks of the corrugations having flat inner and outer portions, said inner portions being offset from the outer portion to define said stop shoulders.

3. A structure as set forth in claim 1 wherein the locking means includes outwardly disposed longitudinally extending stop shoulders on the inwardly convergent flanks of the corrugations, the stop shoulders of adjacent opposing corrugation flanks of the related sub-assemblies establishing opposing stop engagement with each other, said stop shoulders being established by elongate, V-shaped caps engaged over and fixed to the inner, inwardly convergent portions of the flanks of each corrugation.

4. A structure as set forth in claim 1 wherein the locking means includes outwardly disposed longitudinally extending stop shoulders on the inwardly convergent flanks of the corrugations, the stop shoulders of adjacent opposing engaged corrugation flanks of the related sub-assemblies establishing opposing stop engagement with each other.

5. A structure as set forth in claim 4 wherein the stop shoulders are coextensive with the longitudinal extent of the corrugations.

6. A structure as set forth in claim 4 wherein each flank of each corrugation is provided with a plurality of longitudinally spaced stop shoulders, the longitudinal extent of the stop shoulders being no greater than the space between adjacent stop shoulders whereby the opposing stop shoulders on the flanks of the corrugations of related sub-assemblies can be moved out of engagement upon shifting of one sub-assembly relative to the other sub-assembly a distance equal to the longitudinal extent of the stop shoulders in a direction parallel with the axes of the corrugations.

7. An elongated panel structure comprising a pair of flat elongate flexible sheets in set position where they occur in spaced parallel planes defining surface skins of the panel, said sheets having spaced opposing inner surfaces, means between the flexible sheets to orient and hold the sheets in set position and including longitudinally spaced complimentary interengageable angularly related parts on and projecting from the inner surfaces of the sheets, the parts on one sheet engageable in juxtaposition with any of the parts on the other sheet, the parts on said one sheet establishing meshed juxtapositioned relationship with related parts on the said other sheet when the sheets are urged inwardly into set position one relative to the other and yieldingly engageable locking means on and between said parts releasably securing the parts in juxtapositioned relationship.

8. A panel structure as set forth in claim 7 wherein said locking means includes shoulders on the parts on one sheet and spaced from and disposed substantially toward the surface of said one sheet and portion on the parts on the other sheet spaced from the inner surface of said other sheet and engaged by the shoulders.

9. A panel structure set forth in claim 8 wherein said portions on the parts of said other sheet define shoulders disposed substantially toward the inner surface of their related sheet, the shoulders of the juxtapositioned parts being in opposed engagement with each other.

10. A panel structure set forth in claim 9 wherein the parts on one sheet are similar to the parts on the other sheet.

11. An elongate rigid panel structure comprising a pair of elongate flexible sub-assemblies each sub-assembly including a flat skin with inner and outer surfaces and a corrugated backing fixed to the inner surface of the skin, each corrugation having angularly related inwardly convergent flanks, the sub-assemblies being arranged in back to back relationship with the corrugations of each sub-assembly meshed with and seated in the corrugations of the other sub-assembly with the adjacent divergent flanks of adjacent corrugation of each sub-assembly establishing opposing engagement with the two convergent flanks of the corrugations of the other sub-assembly related thereto and yieldingly engageable locking means on and between the adjacent opposing flanks of the meshed corrugations retaining the corrugations in meshed relationship, the sub-assemblies being independently flexible on axes parallel with their corrugations.

12. A structure as set forth in claim 11 wherein the locking means includes outwardly disposed longitudinally extending stop shoulders on the inwardly convergent flanks of the corrugations, the stop shoulders of adjacent opposing corrugation flanks of the related sub-assemblies establishing opposing stop engagement with each other, said stop shoulders being established by elongate, V-shaped caps engaged over and fixed to the inner, inwardly convergent portions of the flanks of each corrugation.

13. A structure as set forth in claim 11 wherein the locking means includes outwardly disposed longitudinally extending stop shoulders on the inwardly convergent flanks of the corrugations, the stop shoulders of adjacent opposing engaged corrugation flanks of the related sub-assemblies establishing opposing stop engagement with each other.

14. A structure as set forth in claim 13 wherein the stop shoulders are coextensive with the longitudinal extent of the corrugations.

15. A structure as set forth in claim 13 wherein each flank of each corrugation is provided with a plurality of longitudinally spaced stop shoulders, the longitudinal extent of the stop shoulders being no greater than the space between adjacent stop shoulders whereby the opposing stop shoulders on the flanks of the corrugations of related sub-assemblies can be moved out of engagement upon shifting of one sub-assembly relative to the other sub-assembly a distance equal to the longitudinal extent of the stop shoulders in a direction parallel with the axes of the corrugations.

16. A structure as set forth in claim 11 wherein the locking means includes outwardly disposed longitudinally extending stop shoulders on the inwardly convergent flanks of the corrugations, the stop shoulders of adjacent opposing corrugation flanks of the related sub-assemblies establishing opposing stop engagement with each other, said flanks of the corrugations having flat inner and outer portions, said inner portions being offset from the outer portion to define said stop shoulders.

* * * * *